US008663757B2

(12) United States Patent
Nito et al.

(10) Patent No.: US 8,663,757 B2
(45) Date of Patent: Mar. 4, 2014

(54) INKJET RECORDING MEDIUM

(75) Inventors: Yasuhiro Nito, Yokohama (JP); Hisao Kamo, Ushiku (JP); Tetsuro Noguchi, Hachioji (JP); Isamu Oguri, Yokohama (JP); Olivia Herlambang, Kawasaki (JP); Naoya Hatta, Kawasaki (JP); Ryo Taguri, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/471,868

(22) Filed: May 15, 2012

(65) Prior Publication Data

US 2012/0295042 A1 Nov. 22, 2012

(30) Foreign Application Priority Data

May 19, 2011 (JP) ..... 2011-112546

(51) Int. Cl.
*B41M 5/00* (2006.01)
*B41M 5/52* (2006.01)

(52) U.S. Cl.
CPC ..... *B41M 5/52* (2013.01); *B41M 5/5254* (2013.01); *B41M 5/5218* (2013.01); *B41M 5/5227* (2013.01)
USPC ..... 428/32.26; 428/32.3; 428/32.34; 428/32.38

(58) Field of Classification Search
CPC .... B41M 5/52; B41M 5/5254; B41M 5/5218; B41M 5/5227
USPC ..... 428/32.26, 32.3, 32.34, 32.38
See application file for complete search history.

(56) References Cited

U.S. PATENT DOCUMENTS

| | | | | |
|---|---|---|---|---|
| 2003/0064208 | A1 * | 4/2003 | Yamada et al. | 428/195 |
| 2004/0086666 | A1 * | 5/2004 | Yoshimura et al. | 428/32.1 |
| 2007/0172608 | A1 | 7/2007 | Tojo | |
| 2007/0273716 | A1 * | 11/2007 | Kakihira et al. | 346/134 |
| 2010/0033527 | A1 | 2/2010 | Kawakami | |

FOREIGN PATENT DOCUMENTS

| | | | |
|---|---|---|---|
| EP | 1612054 | A1 | 1/2006 |
| EP | 2319705 | A2 | 5/2011 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2005-336480 | A | 12/2005 |
| JP | 2006-15655 | A | 1/2006 |

* cited by examiner

*Primary Examiner* — Betelhem Shewareged
(74) *Attorney, Agent, or Firm* — Canon U.S.A., Inc., IP Division

(57) ABSTRACT

An inkjet recording medium includes a support and an ink-receiving layer which is disposed on the support and which contains an alumina pigment and an alkylsulfonic acid having the carbon number of 1 or more and 4 or less. The ink-receiving layer further contains a polymeric compound, a water-soluble zirconium compound, and boric acid or a borate. The polymeric compound is one obtained by cationizing at least one amino group of a product with acid, the product being obtained by the reaction of at least three compounds, that is, (i) a sulfur-containing organic compound containing two or more active hydrogen atoms, (ii) a polyisocyanate compound containing two or more isocyanate groups, and (iii) an amine compound containing two or more active hydrogen atoms.

6 Claims, No Drawings

INKJET RECORDING MEDIUM

BACKGROUND OF THE INVENTION

1. Field of the Invention

The present invention relates to an inkjet recording medium.

2. Description of the Related Art

Inkjet recording media for use in inkjet recording methods usually include ink-receiving layers containing binders such as polyvinyl alcohol and inorganic pigments, such as silica and alumina hydrates, held with the binders. The inkjet recording media need to have color developability, moisture resistance, and ink absorbency. Furthermore, the ink-receiving layers need to be resistant to cracking and scratching when the inkjet recording media are transferred in printers.

Japanese Patent Laid-Open No. 2006-15655 (hereinafter referred to as Patent Document 1) discloses an inkjet recording medium including a support and an ink-receiving layer disposed thereon. The ink-receiving layer is formed using a coating solution containing at least one water-soluble polyvalent metal salt and an aqueous dispersion of a cationically modified self-emulsifying polymer. The aqueous dispersion has an average particle size of 0.05 μm or less. The self-emulsifying polymer is a cationic urethane polymer.

Japanese Patent Laid-Open No. 2005-336480 (hereinafter referred to as Patent Document 2) discloses an inkjet recording medium which includes an ink-receiving layer containing an alumina hydrate and a cationic urethane compound and which has excellent moisture resistance, gas resistance, and light resistance.

Investigations performed by the inventors have shown that the inkjet recording medium, including the ink-receiving layer containing the cationic urethane polymer, disclosed in Patent Document 1 has room for improvement in ink absorbency during high-speed printing. The investigations have also shown that the inkjet recording medium disclosed in Patent Document 2 has room for improvement in ink absorbency during high-speed printing and the ink-receiving layer has room for improvement in scratch resistance during transferring in a printer.

SUMMARY OF THE INVENTION

The present invention provides an inkjet recording medium including an ink-receiving layer. The inkjet recording medium has high color developability, moisture resistance, and ink absorbency during high-speed printing. The cracking resistance and scratch resistance of the ink-receiving layer are ensured when the inkjet recording medium is transferred in a printer.

An embodiment of the present invention relates to an inkjet recording medium including a support and an ink-receiving layer which is disposed on the support and which contains an alumina pigment, an alkylsulfonic acid having the carbon number of 1 or more and 4 or less, a polymeric compound, a water-soluble zirconium compound, and boric acid or a borate. The ink-receiving layer contains 0.5 parts or more and 8 parts or less by mass of the polymeric compound, 0.15 parts or more and 3 parts or less by mass of the water-soluble zirconium compound, and 0.8 parts or more and 3 parts or less by mass of the boric acid or the borate per 100 parts by mass of the alumina pigment; the polymeric compound is one obtained by cationizing with acid at least one amino group of a product, the product being obtained by the reaction of at least three compounds, that is, (i) a sulfur-containing organic compound containing 2 or more active hydrogen atoms, (ii) a polyisocyanate compound containing 2 or more isocyanate groups, and (iii) an amine compound containing 2 or more active hydrogen atoms; and the proportion B/A is 0.02 or more and 6 or less, where A represents parts by mass of the polymeric compound per 100 parts by mass of the alumina pigment and B represents parts by mass of the water-soluble zirconium compound per 100 parts by mass of the alumina pigment.

An inkjet recording medium including an ink-receiving layer can be provided. The inkjet recording medium has high color developability, moisture resistance, and ink absorbency during high-speed printing. The cracking resistance and scratch resistance of the ink-receiving layer are ensured when the inkjet recording medium is transferred in a printer.

Further features of the present invention will become apparent from the following description of exemplary embodiments.

DESCRIPTION OF THE EMBODIMENTS

An inkjet recording medium according to a preferred embodiment of the present invention will now be described in detail. The inkjet recording medium includes a support and an ink-receiving layer disposed on at least one surface of the support.

Support

The support is preferably made of paper such as cast-coated paper, baryta paper, or polymer-coated paper (paper coated with a polymer such as a polyolefin) or made from a film. In particular, the support is preferably made of polymer-coated paper from the viewpoint of the gloss of the ink-receiving layer. The film is preferably a transparent thermoplastic polymer film made of polyethylene, polypropylene, polyester, polylactic acid, polystyrene, polyacetate, polyvinyl chloride, cellulose acetate, polyethylene terephthalate, polymethyl methacrylate, or polycarbonate.

In addition, the following material may be used to form the support: waterleaf paper, which is appropriately sized paper; coated paper; or a sheet-shaped material, such as synthetic paper, made from an opaque film containing an inorganic substance or fine bubbles. Alternatively, a sheet of glass of metal may be used to form the support. In order to enhance the adhesion strength between the support and the ink-receiving layer, the support may be surface-treated by corona discharge, undercoating, or the like.

Ink-receiving Layer (Alumina Pigment)

The ink-receiving layer contains an alumina pigment. The alumina pigment preferably contains an alumina hydrate. The alumina hydrate preferably has the following formula:

$$Al_2O_{3-n}(OH)_{2n}.mH_2O \quad (X)$$

where n is 0, 1, 2, or 3 and m preferably is a value of 0 to 10 and more preferably 0 to 5, provided that n and m are not simultaneously 0. In Formula (X), $mH_2O$ represents water, which is not involved in forming a crystal lattice and is detachable, and therefore m may be an integer or a non-integer. Heating may possibly allow m to be 0.

The alumina hydrate is present in an amorphous form or in the form of gibbsite or boehmite depending on the temperature of heat treatment and may have any crystal structure. The alumina hydrate is particularly preferably in the form of boehmite or in an amorphous form as characterized by X-ray diffraction. In particular, the alumina hydrate may be any one of those disclosed in Japanese Patent Laid-Open Nos. 7-232473, 8-132731, 9-66664, and 9-76628. The alumina hydrate is preferably selected such that the ink-receiving layer has an average pore radius of 7.0 nm or more and 10 nm or less when the ink-receiving layer is formed. The ink-receiving layer more preferably has an average pore radius of 8.0 nm or more. When the average pore radius of the ink-receiving layer is within the above range, the ink-receiving layer can exhibit excellent ink absorbency and color developability. When the average pore radius of the ink-receiving layer is less than the above range, the ink absorbency thereof is insufficient and therefore sufficient ink absorbency cannot be achieved in some cases even if the amount of a binder is adjusted with respect to the alumina hydrate. When the average pore radius of the ink-receiving layer is greater than the above range, the ink-receiving layer has a large haze and therefore sufficient color developability cannot be achieved in some cases. No pores with a radius of 25 nm or more are preferably present in the ink-receiving layer. When pores with a radius of 25 nm or more are present in the ink-receiving layer, the ink-receiving layer has a large haze and therefore cannot exhibit sufficient color developability in some cases.

The ink-receiving layer preferably has a total pore volume of 0.50 ml/g or more. When the total pore volume thereof is less than 0.50 ml/g, the ink absorbency of the ink-receiving layer is insufficient and therefore sufficient ink absorbency cannot be achieved in some cases even if the amount of the binder is adjusted with respect to the alumina hydrate.

The average pore radius and the total pore volume are values determined by the Barrett-Joyner-Halenda (BJH) method from a nitrogen adsorption-desorption isotherm obtained by measuring a recording medium by a nitrogen adsorption-desorption method. In particular, the average pore radius is a value calculated from the total pore volume and specific surface area determined by nitrogen desorption.

In the case of measuring the inkjet recording medium by the nitrogen adsorption-desorption method, portions other than the ink-receiving layer are also measured. However, components (for example, the support, a polymer coating, and the like) other than the ink-receiving layer do not have 1-100 nm pores that can be generally measured by the nitrogen adsorption-desorption method. Therefore, measuring the inkjet recording medium by the nitrogen adsorption-desorption method is probably synonymous with measuring the average pore radius of the ink-receiving layer. This is inferred from the fact that polymer-coated paper does not have 1-100 nm pores as measured for pore distribution by the nitrogen adsorption-desorption method.

In order to allow the ink-receiving layer to have the above average pore radius, the alumina hydrate preferably has a BET specific surface area of 100 $m^2/g$ or more and 200 $m^2/g$ or less and more preferably 125 $m^2/g$ or more and 175 $m^2/g$ or less. The BET method is one of ways to measure the surface area of particles by gas phase adsorption and is a technique for determining the surface area of 1 g of a sample, that is, the specific surface area thereof from an adsorption isotherm. In the BET method, a nitrogen gas is usually used as an adsorption gas and a way to determine the amount of adsorption from the change in pressure or volume of an adsorption gas is most widely used. The Brunauer-Emmett-Teller equation is one of the most famous equations expressing multimolecular adsorption isotherms, is called the BET equation, and is widely used to determine the specific surface area. In the BET method, the amount of adsorption is determined by the BET equation and the specific surface area is obtained by multiplying the amount of adsorption by the area occupied by one adsorbed molecule. In the BET method, the amount of adsorption is measured at a relative pressure by the nitrogen adsorption-desorption method several times, the slope and y-intercept of a plot of the relationship therebetween are determined, and the specific surface area is derived from the slope and y-intercept. Therefore, in order to increase the accuracy of measurement, the relationship between the amount of adsorption and the relative pressure is preferably measured at least five times and more preferably ten times or more.

Particles of the alumina hydrate are tabular and preferably have an average aspect ratio of 3.0 or more and 10 or less and a tabular surface with a vertical-to-horizontal ratio of 0.60 or more and 1.0 or less. The aspect ratio can be determined by a method disclosed in Japanese Patent Publication No. 5-16015. The aspect ratio is herein expressed as the ratio of the diameter to the thickness of a particle. The term "diameter" as used herein refers to the diameter (equivalent circle diameter) of a circle having the same area as the projected area of a particle of the alumina hydrate as observed with a microscope or an electron microscope. The vertical-to-horizontal ratio of the tabular surface, as well as the aspect ratio, is defined as the ratio of the longitudinal size to transverse size of the tabular surface as observed with a microscope. When the aspect ratio of the alumina hydrate is outside the above range, the pore distribution of the ink-receiving layer is narrow in some cases. Therefore, it is difficult to synthesize the alumina hydrate such that the alumina hydrate has a uniform particle size. Likewise, when the vertical-to-horizontal ratio is outside the above range, the pore distribution of the ink-receiving layer is narrow.

There are hairy alumina hydrates and non-hairy alumina hydrates as well known. According to findings of the inventors, tabular alumina hydrates are superior in dispersibility to the hairy alumina hydrates. A hairy alumina hydrate is oriented in parallel to a surface of the support during coating, formed pores are small, and therefore the ink-receiving layer has low ink absorbency. In contrast, a tabular alumina hydrate slightly tends to be oriented during coating and is unlike to adversely affect the size of pores formed in the ink-receiving layer and the ink absorbency of the ink-receiving layer. Therefore, the tabular alumina hydrate is preferably used.

A preferred example of the alumina hydrate is DISPERAL HP14 available from Sasol.

Another Alumina Pigment

The ink-receiving layer may further contain another alumina pigment such as γ-alumina, α-alumina, δ-alumina, θ-alumina, or χ-alumina in addition to the alumina hydrate. In particular, γ-alumina (hereinafter referred to as "vapor phase process alumina"), which is synthesized by a vapor phase process, is preferred from the viewpoint of ink absorbency and scratch resistance during transferring. γ-Alumina is obtained in such a manner that an alumina hydrate produced by a known process is heated at a temperature of 400° C. or more and 900° C. or less and is then calcined.

From the viewpoint of ink absorbency and scratch resistance during transferring, vapor phase process alumina preferably has a BET specific surface area less than that of the alumina hydrate, that is, a large primary particle size. A mechanism to improve scratch resistance is not clear but is probably as described below. When tabular particles of the alumina hydrate are present on a surface of a recording medium (a surface of a first ink-receiving layer), the recording medium is deformed and the direction of the tabular particles present thereon is changed during pressing with transferring rollers; hence, the gloss of the recording medium is slightly changed. The change in gloss thereof allows scratches caused during transferring to be conspicuous. On the other hand, particles of vapor phase process alumina have a shape relatively close to a spherical shape and are isotropic in shape; hence, the change in gloss thereof is relatively small even though the direction of the particles is changed. This probably allows scratches caused during transferring to be inconspicuous.

Vapor phase process alumina preferably has a BET specific surface area of 50 $g/m^2$ or more and more preferably 80 $g/m^2$ or more. Vapor phase process alumina preferably has a BET specific surface area of 150 $g/m^2$ or less and more preferably 120 $g/m^2$ or less. Vapor phase process alumina preferably has a primary particle size of 5 nm or more and more preferably 11 nm or more. Vapor phase process alumina preferably has a primary particle size of 30 nm or less and more preferably 15 nm or less.

Vapor phase process alumina may be a commercially available product. Examples of the commercially available product include AEROXIDE AluC, having a primary particle size of 13 nm and a BET specific surface area of 100 $g/m^2$, available from EVONIC; AEROXIDE Alu130, having a primary particle size of 10 nm and a BET specific surface area of 130 $g/m^2$, available from EVONIC; and AEROXIDE Alu65, having a primary particle size of 20 nm and a BET specific surface area of 65 $g/m^2$, available from EVONIC.

The use of AEROXIDE AluC and AEROXIDE Alu65 leads to an increase in ink absorbency and an increase in scratch resistance during transferring and therefore is preferred. The use of AEROXIDE AluC suppresses the reduction of color developability and therefore is particularly preferred. The mass ratio of the alumina hydrate to vapor phase process alumina preferably ranges from 100:0 to 70:30, more preferably 60:40 to 95:5, and further more preferably 70:30 to 90:10.

Binder

The ink-receiving layer preferably contains a binder. The binder is a material which can bind the alumina hydrate and which can form a coating. The binder is not particularly limited unless advantages of the present invention are diminished. Examples of the binder include starch derivatives such as oxidized starch, etherified starch, and starch esterified with phosphoric acid; cellulose derivatives such as carboxymethyl cellulose and hydroxyethyl cellulose; casein; casein derivatives; gelatin derivatives; soy protein; soy protein derivatives; polyvinyl alcohol; polyvinyl alcohol derivatives; conjugated polymer latexes such as polyvinylpyrrolidone, maleic anhydride polymers, styrene-butadiene copolymers, and methyl methacrylate-butadiene copolymers; acrylic polymer latexes such as acrylic ester polymers and methacrylic ester polymers; vinyl polymer latexes such as ethylene-vinyl acetate copolymers; functional group-modified polymer latexes prepared from monomers, containing a functional group such as a carboxyl group, for the above polymers; those prepared by cationizing the above polymers with a cationizing agent; those prepared by surface-cationizing the above polymers with a cationizing surfactant; those prepared in such a manner that the above polymers are polymerized in the presence of cationic polyvinyl alcohol such that polyvinyl alcohol is distributed on the polymers; those prepared in such a manner that the above polymers are polymerized in suspensions or dispersions of cationic colloidal particles such that the cationic colloidal particles are distributed on the polymers; aqueous binders derived from thermosetting polymers such as melamine polymers and urea polymers; polymers or copolymers, such as polymethyl methacrylate, prepared from acrylic esters or methacrylic esters; and synthetic polymer binders such as polyurethane polymers, unsaturated polyester polymers, polyvinyl chloride-vinyl alcohol copolymers, polyvinyl butyral, and alkyd polymers.

These materials can be used alone or in combination. In particular, a polyvinyl alcohol is most preferred. The polyvinyl alcohol can usually be obtained by hydrolyzing polyvinyl acetate. The polyvinyl alcohol preferably has an average degree of polymerization of 1,500 or more and more preferably 2,000 or more and 5,000 or less. The polyvinyl alcohol preferably has a saponification value of 80 or more and 100 or less and more preferably 85 or more and 100 or less.

The amount of the polyvinyl alcohol contained in the ink-receiving layer is preferably 7.0% or more and 12.0% or less by mass of the alumina hydrate and more preferably 8.0% or more and 9.0% or less. When the amount thereof is less than 7.0% by mass, a high-strength coating is unlikely to be formed. When the amount thereof is more than 12.0% by mass, gelation is promoted and coating properties are reduced in some cases.

Deflocculation Agent

The ink-receiving layer contains a deflocculation agent such as an alkylsulfonic acid having the carbon number of 1 or more and 4 or less for the purpose of stably dispersing the alumina hydrate. The use of an alkylsulfonic acid containing 5 or more carbon atoms or an alkylsulfonic acid containing a benzene ring as the deflocculation agent is likely to cause a reduction in color stability and a reduction in image density. The reason for this is probably that since deflocculation agents become more hydrophobic with an increase in number of carbon atoms and therefore the surface of alumina becomes become more hydrophobic, the rate of fixing a dye on the surface of alumina is reduced. In the case of deflocculating the alumina hydrate with such an alkylsulfonic acid containing 5 or more carbon atoms or an alkylsulfonic acid containing a benzene ring, it is difficult to achieve sufficient dispersion stability, an increase in viscosity is likely to be caused, a reduction in productivity is caused, and a reduction in image density is caused because the alumina hydrate is coagulated.

The alkylsulfonic acid having the carbon number of 1 or more and 4 or less is preferably a monobasic acid containing a solubilizing group such as a sulfo group only. The alkylsulfonic acid having the carbon number of 1 or more and 4 or less preferably contains an alkyl group free from a solubilizing group such as a hydroxyl group or a carboxyl group from the viewpoint of moisture resistance. The alkyl group is preferably unsubstituted. The alkyl group may be linear or branched. Preferred examples of the alkylsulfonic acid include methanesulfonic acid, ethanesulfonic acid, isopropanesulfonic acid, n-propanesulfonic acid, n-butanesulfonic acid, isobutanesulfonic acid, and t-butanesulfonic acid. In particular, methanesulfonic acid, ethanesulfonic acid, isopropanesulfonic acid, and n-propanesulfonic acid, which have the carbon number of 1 or more and 3 or less, are preferred. Methanesulfonic acid is particularly preferred.

The amount of the alkylsulfonic acid having the carbon number of 1 or more and 4 or less contained in the ink-receiving layer is preferably 1.0 part or more and 2.0 parts or less by mass per 100 parts by mass of the alumina pigment. When the amount thereof is less than 1.0 part by mass, the ink-receiving layer has reduced ozone resistance in some cases. When the amount thereof is more than 2.0 parts by mass, the ink-receiving layer has unsatisfactory ink absorbency in some cases. The amount thereof is more preferably 1.3 parts or more and 1.6 parts or less by mass.

Water-soluble Zirconium Compound

The ink-receiving layer contains a water-soluble zirconium compound for the purpose of achieving increased scratch resistance and ink absorbency. Examples of the water-soluble zirconium compound include zirconium acetate, zirconium nitrate, zirconium sulfate, ammonium zirconium carbonate, potassium zirconium carbonate, and zirconium chloride. In particular, zirconium acetate is preferred because zirconium acetate can be most readily added to an alumina coating solution without impairing the dispersibility of the alumina coating solution. The amount of the added water-soluble zirconium compound is 0.15 parts or more and 3 parts or less by mass per 100 parts by mass of the alumina pigment. When the amount thereof is less than 0.15 parts by mass, the effect of scratch resistance is low. When the amount thereof is more than 3 parts by mass, the ink-receiving layer may possibly be cracked when the inkjet recording medium is significantly warped during transferring (cracking during bending). The amount thereof is preferably 0.3 parts or more and 1 part or less by mass.

Boric Acid or Borate

The ink-receiving layer contains boric acid or a borate, which is a component, other than the water-soluble zirconium compound, for crosslinking the binder, for the purpose of achieving increased scratch resistance and ink absorbency. The amount of boric acid or the borate contained in the ink-receiving layer is 0.8 parts or more and 3 parts or less by mass per 100 parts by mass of the alumina pigment. When the amount thereof is less than 0.8 parts by mass, the ink absorbency and scratch resistance of the ink-receiving layer are insufficient. When the amount thereof is more than 3 parts by mass, the ink-receiving layer may possibly be cracked when the inkjet recording medium is significantly warped during transferring (cracking during bending). The amount thereof is preferably 1 part or more and 3 parts or less by mass and more preferably 1 part or more and 2 parts or less by weight. An example of the borate is sodium borate.

Polymeric Compound

The ink-receiving layer contains a polymeric compound. The polymeric compound is one obtained by cationizing at least one amino group of a product with acid, the product being obtained by the reaction of at least three compounds, that is, a sulfur-containing organic compound (hereinafter referred to as Compound (i)) containing two or more active hydrogen atoms, a polyisocyanate compound (hereinafter referred to as Compound (ii)) containing two or more isocyanate groups, and an amine compound (hereinafter referred to as Compound (iii)) containing two or more active hydrogen atoms. The polymeric compound has a weight-average molecular weight of 2,000 to 150,000. The polymeric compound may be at least one selected from the group consisting of compounds represented by the following formulae:

(1)

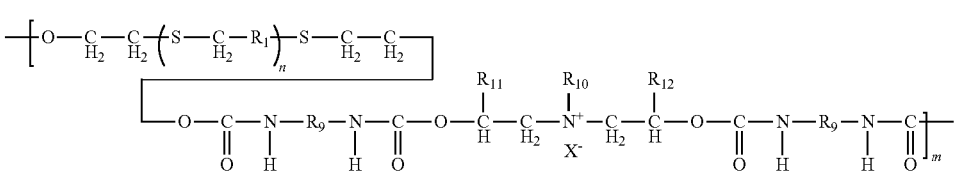

where n represents 1 or 2; $R_1$ represents a methylene group, an ethylene group, or a propylene group; $R_9$ represents an alkylene group or an aliphatic hydrocarbon group containing one or more polyalicyclic groups (alicyclic structures); $R_{10}$ represents an alkyl group having the carbon number of 1 or more and 4 or less; $R_{11}$ and $R_{12}$ independently represent a hydrogen atom or a methyl group; and $X^-$ represents an acid anion, (2)

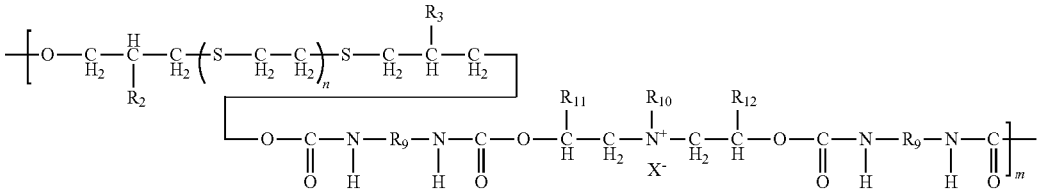

where n represents 1 or 2; $R_2$ and $R_3$ independently represent a hydrogen atom, a hydroxyl group, or an alkyl group and may be the same as or different from each other; $R_9$ represents an alkylene group or an aliphatic hydrocarbon group containing one or more polyalicyclic groups (alicyclic structures); $R_{10}$ represents an alkyl group having the carbon number of 1 or more and 4 or less; $R_{11}$ and $R_{12}$ independently represent a hydrogen atom or a methyl group; and $X^-$ represents an acid anion, (3)

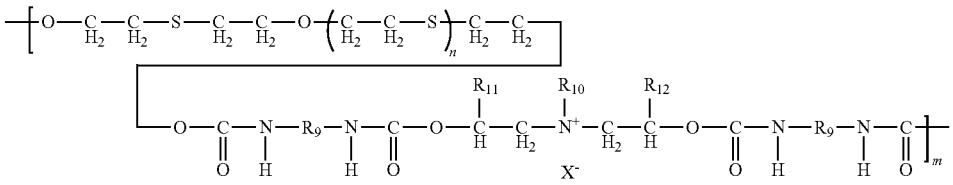

where n represents 0 or 1, $R_9$ represents an alkylene group or an aliphatic hydrocarbon group containing one or more polyalicyclic groups (alicyclic structures), $R_{10}$ represents an alkyl group having the carbon number of 1 or more and 4 or less, $R_{11}$ and $R_{12}$ independently represent a hydrogen atom or a methyl group, and $X^-$ represents an acid anion, (4)

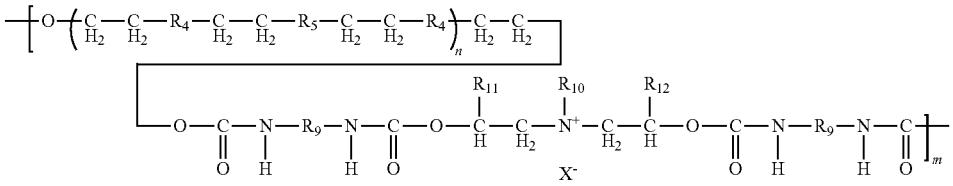

where n represents 1 or 2, $R_4$ represents a sulfur atom or an oxygen atom, $R_5$ represents a sulfur atom or a sulfonyl group, $R_4$ and $R_5$ are different from each other, $R_9$ represents an alkylene group or an aliphatic hydrocarbon group containing one or more polyalicyclic groups (alicyclic structures), $R_{10}$ represents an alkyl group having the carbon number of 1 or more and 4 or less, $R_{11}$ and $R_{12}$ independently represent a hydrogen atom or a methyl group, and $X^-$ represents an acid anion, (5)

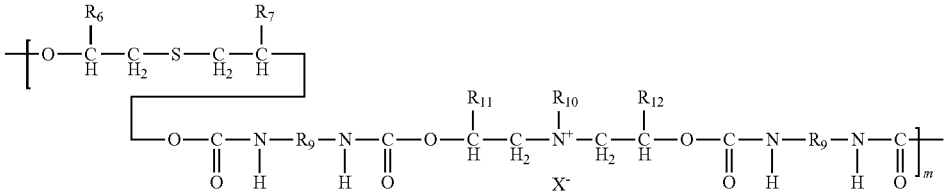

where $R_6$ and $R_7$ independently represent a hydrogen atom or a methyl group and may be the same as or different from each other, $R_9$ represents an alkylene group or an aliphatic hydrocarbon group containing one or more polyalicyclic groups (alicyclic structures), $R_{10}$ represents an alkyl group having the carbon number of 1 or more and 4 or less, $R_{11}$ and $R_{12}$ independently represent a hydrogen atom or a methyl group, and $X^-$ represents an acid anion, and (6)

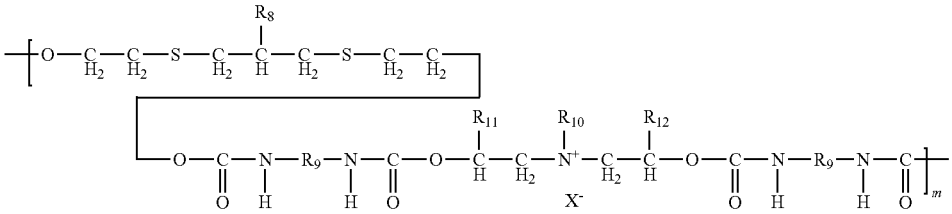

where $R_8$ represents a hydroxyl group or an alkyl group, $R_9$ represents an alkylene group or an aliphatic hydrocarbon group containing one or more polyalicyclic groups (alicyclic structures), $R_{10}$ represents an alkyl group having the carbon number of 1 or more and 4 or less, $R_{11}$ and $R_{12}$ independently represent a hydrogen atom or a methyl group, and $X^-$ represents an acid anion. In Formulae (1) to (6), m is determined such that the weight-average molecular weight of the polymeric compound is within the above range.

Compound (i), which is used to synthesize the polymeric compound, is not particularly limited and is preferably one containing at least one sulfide group. In particular, Compound (i) may be at least one selected from the group consisting of compounds represented by the following formulae:

(7)

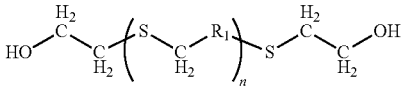

where n represents 1 or 2 and $R_1$ represents a methylene group, an ethylene group, or a propylene group, (8)

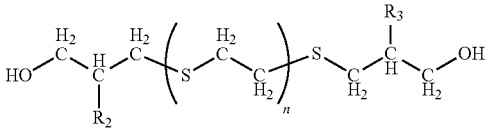

where n represents 1 or 2 and $R_2$ and $R_3$ independently represent a hydrogen atom, a hydroxyl group, or an alkyl group and may be the same as or different from each other, (9)

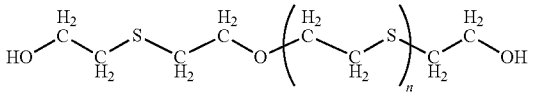

where n represents 0 or 1, (10)

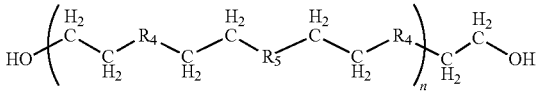

where n represents 1 or 2, $R_4$ represents a sulfur atom or an oxygen atom, $R_5$ represents a sulfur atom or a sulfonyl group, and $R_4$ and $R_5$ are different from each other, (11)

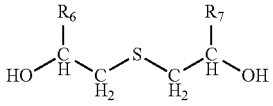

where $R_6$ and $R_7$ independently represent a hydrogen atom or an alkyl group and may be the same as or different from each other, and (12)

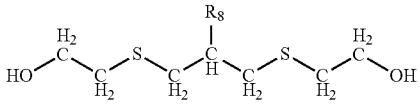

where $R_8$ represents a hydroxyl group or an alkyl group. In particular, the compound represented by Formula (8) or (12) is highly effective in suppressing image discoloration due to light or an acidic gas in the atmosphere and is preferred. These compounds can be used alone or in combination to synthesize the polymeric compound.

Examples of Compound (ii), which is used to synthesize the polymeric compound, include, but are not limited to, 2,4-tolylene diisocyanate, 2,6-tolylene diisocyanate, m-phenylene diisocyanate, p-phenylene diisocyanate, 4,4'-diphenylmethane diisocyanate, 2,4'-diphenylmethane diisocyanate, 2,2'-diphenylmethane diisocyanate, 3,3'-dimethyl-4,4'-biphenylene diisocyanate, 3,3'-dichloro-4,4'-biphenylene diisocyanate, 1,5-naphthalene diisocyanate, 1,5-tetrahydronaphthalene diisocyanate, tetramethylene diisocyanate, 1,6-hexamethylene diisocyanate, dodecamethylene diisocyanate, trimethylhexamethylene diisocyanate, 1,3-cyclohexylene diisocyanate, 1,4-cyclohexylene diisocyanate, xylylene diisocyanate, tetramethylxylylene diisocyanate, hydrogenated xylylene diisocyanate, lysine diisocyanate, isophorone diisocyanate, and 4,4'-dicyclohexylmethane diisocyanate. These compounds can be used alone or in combination to synthesize the polymeric compound.

Compound (iii), which is used to synthesize the polymeric compound, is preferably, for example, a tertiary amine represented by the following formula:

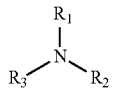

(13)

where one of $R_1$, $R_2$, and $R_3$ represents an alkyl group containing one to six carbon atoms, an alkanol group, or an aminoalkyl group and the others may be the same as or different from each other and represent an alkanol group, an aminoalkyl group, or an alkanethiol group.

Examples of Compound (iii) include diol compounds such as N-methyl-N,N-diethanolamine, N-ethyl-N,N-diethanolamine, N-isobutyl-N,N-diethanolamine, N-t-butyl-N,N-diethanolamine, and N-t-butyl-N,N-diisopropanolamine; triol compounds such as triethanolamine; diamine compounds such as methyliminobispropylamine and butyliminobispropylamine; and triamine compounds such as tri(2-aminoethyl) amine. These compounds can be used alone or in combination to synthesize the polymeric compound.

The polymeric compound is obtained by the reaction of Compound (i), Compound (ii), and Compound (iii) in the form of a polymer containing Compound (i) units, Compound (ii) units, and Compound (iii) units (the units contain a cationized tertiary amino group). The content of Compound (iii) in the polymeric compound is preferably 5.5% or more and 18.5% or less on a molar basis. When the content of Compound (iii) is less than 5.5% on a molar basis, the content of a hydrophilic group is low; hence, it is inconvenient to prepare an aqueous dispersion of the polymeric compound or it is difficult to blend the polymeric compound with an aqueous coating solution used to form the ink-receiving layer in some cases. When the content of Compound (iii) is more than 18.5% on a molar basis, the inkjet recording medium, which contains the polymeric compound, has reduced gloss or print density in some cases.

If the content of Compound (iii) in the polymeric compound is within the above range, the amount of the Compound (iii) units can account for 3% or more and 80% or less by mass of the polymeric compound. If the content thereof is outside the above range, then the reduction in function of the polymeric compound is caused in some cases.

When the content of Compound (iii) in the polymeric compound is within the above range, the amount of the incorporated Compound (i) units preferably accounts for 10% or more and 65% or less by mass of the polymeric compound and more preferably 30% or more and 65% or less by mass thereof. When the amount of the Compound (i) units is less than 10%, the polymeric compound has an insufficient effect in some cases. When the amount of the Compound (i) units is more than 65%, the content of a hydrophilic group is low and therefore it is inconvenient to prepare an aqueous dispersion of the polymeric compound in some cases.

Compound (ii) has a function of linking Compound (i) and Compound (iii) together. The amount of Compound (ii) used is not particularly limited. When the content of Compound (iii) is within the above range, the amount of the Compound (ii) units preferably accounts for 10% or more and 80% or less by mass of the polymeric compound and more preferably 30% or more and 60% or less by mass thereof. When the amount of the Compound (ii) units is within the above range, sufficient amounts of Compound (i) units and Compound (iii) units can be linked to each other so as to exhibit functions thereof.

A method of synthesizing the polymeric compound from Compounds (i) to (iii) may be a one-shot method or a prepolymer method. In the one-shot method, Compounds (i) to (iii) are polymerized together into a random polymer. In the prepolymer method, a prepolymer terminated with isocyanate groups is synthesized by the reaction of Compound (i) (or Compound (iii)) with Compound (ii) under an isocyanate group-rich condition and is then allowed to react with Compound (iii) (or Compound (i)). In both methods, a chain extender such as a low-molecular weight polyol or diamine may be used. The molecular weight of the polymeric compound can be adjusted by varying the amounts of Compounds (i) to (iii) used or by adding a terminator such as a monoalcohol or a monoamine to a reaction system.

The polymeric compound preferably has a weight-average molecular weight of 2,000 or more and 150,000 or less and more preferably 2,000 or more and 50,000 or less depending on reaction conditions. When the weight-average molecular weight of the polymeric compound is less than 2,000, gloss or print density is low in some cases. When the weight-average molecular weight of the polymeric compound is more than 150,000, the reaction time is long and therefore synthesis cost is high, which is not preferred.

In the synthesis of the polymeric compound, a compound (hereinafter referred to as Compound (iv)), other than Compounds (i) and (iii), containing two or more active hydrogen atoms may be copolymerized as required. Examples of Compound (iv) include polyester polyols, polyether polyols, and polycarbonate polyols, which may be used alone or in combination.

Examples of the polyester polyols include polyesters obtained by the dehydrocondensation of glycols such as ethylene glycol, propylene glycol, 1,3-propanediol, 1,4-butanediol, 1,5-pentanediol, 3-methyl-1,5-pentanediol, 1,6-hexanediol, neopentyl glycol, diethylene glycol, triethylene glycol, tetraethylene glycol, polyethylene glycol having a molecular weight of 300 to 1,000, dipropylene glycol, tripropylene glycol, bishydroxyethoxybenzene, 1,4-cyclohexane dimethanol, bisphenol A, bisphenol S, hydrogenated bisphenol A, hydroquinone, and alkylene oxide adducts with acids such as malonic acid, succinic acid, glutaric acid, adipic acid, pimelic acid, suberic acid, azelaic acid, sebacic acid, hendecanedicarboxylic acid, decanedicarboxylic acid, dodecanedicarboxylic acid, maleic anhydride, fumaric acid, 1,3-cyclopentanedicarboxylic acid, terephthalic acid, isophthalic acid, phthalic acid, 1,4-naphthalenedicarboxylic acid, 2,5-naphthalenedicarboxylic acid, 2,6-naphthalenedicarboxylic acid, naphthalic acid, biphenyldicarboxylic acid, 1,2-bisphenoxyethane-p,p'-dicarboxylic acid, dicarboxylic anhydrides, and ester-forming derivatives; polyesters obtained by the ring-opening polymerization of cyclic esters such as ε-caprolactone; and polyesters obtained by copolymerizing these compounds.

Examples of the polyether polyols include products obtained by addition-polymerizing one or more of monomers such as ethylene oxide, propylene oxide, butylene oxide, styrene oxide, epichlorohydrin, tetrahydrofuran, and cyclohexylane using a compound, such as ethylene glycol, diethylene glycol, triethylene glycol, propylene glycol, trimethylene glycol, 1,3-butanediol, 1,4-butanediol, 1,5-pentanediol, 1,6-hexanediol, neopentyl glycol, glycerin, trimethylolethane, trimethylolpropane, sorbitol, sucrose, bisphenol A, bisphenol S, hydrogenated bisphenol A, aconitic acid, trimellitic acid, hemimellitic acid, phosphoric acid, ethylene diamine, diethylene triamine, triisopropanolamine, pyrogallol, dihydroxybenzoic acid, hydroxyphthalic acid, or 1,2,3-propanetrithiol, containing at least two active hydrogen atoms as an initiator in accordance with common practice. Other examples of the polyether polyols include products obtained by addition-polymerizing one or more of monomers such as ethylene oxide, propylene oxide, butylene oxide, styrene oxide, epichlorohydrin, tetrahydrofuran, and cyclohexylane using a compound, such as ethylene diamine or propylene diamine, containing at least two primary amino groups as an initiator in accordance with common practice. In particular, polyethylene glycol is preferred.

Examples of the polycarbonate polyols include compounds obtained by the reaction of glycols such as 1,4-butanediol, 1,6-hexanediol, and diethylene glycol with diphenyl carbonate and phosgene.

For the polymeric compound, a tin catalyst and/or an amine catalyst are preferably used in an isocyanate polyaddition reaction. Examples of the tin catalyst include dibutyltin laurate and stannous octoate. Examples of the amine catalyst include, but are not limited to, triethylene diamine, triethylamine, tetramethylpropane diamine, tetramethylbutane diamine, and N-methylmorpholine.

The isocyanate polyaddition reaction can be carried out in the absence of any solvent depending on the composition. However, a hydrophilic organic solvent not involved in the isocyanate polyaddition reaction is usually used as a reaction solvent for the purpose of suppressing the reaction of a reaction system and for the purpose of controlling the viscosity of a base. Examples of the hydrophilic organic solvent include ketones such as acetone, methyl ethyl ketone, methyl isobutyl ketone, and diisobutyl ketone; organic acid esters such as methyl formate, ethyl formate, propyl formate, butyl formate, methyl acetate, ethyl acetate, propyl acetate, butyl acetate, methyl propionate, ethyl propionate, and butyl propionate; and amines such as N,N'-dimethylformamide and N-methylpyrrolidone. The used hydrophilic organic solvent is preferably finally removed.

The polymeric compound can be stably dispersed or dissolved in water in such a manner that at least one portion of the Compound (iii) units is cationized with acid. If the Compound (iii) units are cationized with a quaternizer such as an alkyl halide, the polymeric compound cannot be stably dispersed in water in the form of particles with a preferred size or cannot be dissolved in water. The acid used herein is not particularly limited and is preferably phosphoric acid and/or a monovalent acid because the use of a polyvalent acid may possibly cause an increase in viscosity when the polymeric compound is dispersed or dissolved in water. For example, phosphorous acid may be used instead of phosphoric acid. Examples of the monovalent acid include organic acids such as formic acid, acetic acid, propionic acid, butyric acid, glycolic acid, lactic acid, pyruvic acid, and methanesulfonic acid and inorganic acids such as hydrochloric acid and nitric acid. These acids cationize the Compound (iii) units to convert into acid anions. The use of the polymeric compound cationized with a hydroxy acid to form the ink-receiving layer of the inkjet recording medium suppresses the yellow discoloration of an unprinted portion (a white portion) rather than the use of the polymeric compound cationized with another acid. Therefore, the polymeric compound cationized with a hydroxy acid is preferably used.

Preferred examples of the polymeric compound, which is obtained as described above, are those represented by Formulae (1) to (6).

The amount of the polymeric compound contained in the ink-receiving layer is 0.5 parts or more and 8 parts or less by mass per 100 parts by mass of the alumina pigment. In particular, the amount of the polymeric compound contained in the ink-receiving layer is preferably 2 parts or more and 4 parts or less by mass per 100 parts by mass of the alumina pigment.

In the ink-receiving layer, the proportion B/A is 0.02 parts or more and 6 or less, where A represents parts by mass of the polymeric compound per 100 parts by mass of the alumina pigment and B represents parts by mass of the water-soluble zirconium compound per 100 parts by mass of the alumina pigment. When the proportion B/A is less than 0.02, the effect of scratch resistance is low. When the proportion B/A is more than 6, the ink-receiving layer is cracked during transferring in some cases (cracking during bending). Therefore, the proportion B/A preferably is 0.1 or more and 1.5 or less and more preferably 0.15 or more and 0.2 or less.

The average particle size of a dispersion prepared by dispersing the polymeric compound in an aqueous medium is preferably 5 nm or more and 500 nm or less from the viewpoint of storage stability. In order to allow the polymeric compound to be stably present in an alumina dispersion containing the water-soluble zirconium compound and in order to increase the ink absorbency of the inkjet recording medium, the average particle size of the dispersion preferably is preferably more than 50 nm and 200 nm or less. The average particle size used herein is determined by dynamic light scattering and can be readily measured with, for example, Nanotrac UPA-150EX available from Nikkiso Co., Ltd.

The glass transition temperature (Tg) of the polymeric compound is preferably 50° C. or more and 80° C. or less. The glass transition temperature thereof can be readily measured by differential scanning calorimetry (DSC). When being coexistent, the polymeric compound and the water-soluble zirconium compound aggregate adequately to form pores in a drying step in the course of producing the inkjet recording medium. When the glass transition temperature of the polymeric compound is 50° C. or more and 80° C. or less, the polymeric compound interacts with the water-soluble zirconium compound to form pores while the polymeric compound is present in the form of particles, probably leading to the formation of a film due to drying. This results in that the inkjet recording medium is obtained so as to have a pore structure excellent in ink absorbency during high-speed printing. When the glass transition temperature thereof is lower than 50° C., a film is formed before drying or immediately after drying; hence, the pores are not formed and therefore the effect of increasing ink absorbency is low. When the glass transition temperature thereof is higher than 80° C., particles remain after the drying step and it is difficult to obtain a transparent film in some cases.

The amount of the polymeric compound contained in the ink-receiving layer is 0.5 parts or more and 8 parts or less by mass per 100 parts by mass of the alumina pigment. When the amount thereof is less than 0.5 parts by mass, the ink absorbency of the ink-receiving layer is insufficient. When the amount thereof is more than 8 parts by mass, the color developability of the ink-receiving layer is low. The amount thereof is more preferably 2 parts or more and 4 parts or less by mass.

Additive

The inkjet recording medium may contain an additive such as a pH adjustor, a pigment dispersant, thickening agent, a flow improver, an antifoam, a foam inhibitor, a surfactant, a releasing agent, a penetrant, a coloring pigment, or a coloring dye. Furthermore, the inkjet recording medium may contain a fluorescent whitening agent, an ultraviolet absorber, a preservative, an antimildew agent, a water resistant additive, a dye fixative, a curing agent, a weather-resistant material, and the like.

EXAMPLES

The present invention is further described below in detail with reference to examples and comparative examples. The present invention is not limited to the examples or the comparative examples. All parts and percentages below are on a mass basis unless otherwise specified.

Synthesis of Polymeric Compound 1-1

Polymeric Compound 1-1 was synthesized as described below. A reaction solvent, that is, 140 g of acetone was poured into a reaction vessel equipped with a stirrer, a thermometer, and a reflux cooling tube and 50.00 g of 3,6-dithia-1,8-octanediol and 10.46 g of methyl diethanolamine were dissolved in acetone by stirring. The reaction vessel was heated to 40° C. and 79.66 g of isophorone diisocyanate was then added thereto. The reaction vessel was heated to 50° C. and 0.4 g of a tin catalyst was then added thereto. The reaction vessel was heated to 55° C. and reaction was carried out for four hours under stirring.

After reaction was terminated, the reaction mixture was cooled to room temperature. To the reaction mixture, 9.14 g of 35% hydrochloric acid was added for cationization. To the resulting reaction mixture, 573 g of water added. Acetone was removed from the reaction mixture by vacuum concentration. The concentration of the residue was adjusted with water, whereby an aqueous dispersion of Polymeric Compound 1-1 with a solid content of 20% was prepared. The aqueous dispersion was diluted to 1% with water and was then measured for average particle size using UPA-150EX, resulting in that the average particle size thereof was 35 nm. The glass transition temperature (Tg) of Polymeric Compound 1-1 was measured to be 60° C. Synthesis of Polymeric Compound 1-2

Polymeric Compound 1-2 was synthesized in substantially the same manner as that used to synthesize Polymeric Compound 1-1 except that 55.00 g of 3,6-dithia-1,8-octanediol was used. An aqueous dispersion of Polymeric Compound 1-2 with a solid content of 20% was also prepared. The average particle size of this aqueous dispersion was 54 nm. The glass transition temperature of Polymeric Compound 1-2 was 64° C.

Synthesis of Polymeric Compound 1-3

Polymeric Compound 1-3 was synthesized in substantially the same manner as that used to synthesize Polymeric Compound 1-1 except that 48.00 g of 3,6-dithia-1,8-octanediol was used. An aqueous dispersion of Polymeric Compound 1-3 with a solid content of 20% was also prepared. The average particle size of this aqueous dispersion was 96 nm. The glass transition temperature of Polymeric Compound 1-3 was 60° C.

Synthesis of Polymeric Compound 1-4

Polymeric Compound 1-4 was synthesized in substantially the same manner as that used to synthesize Polymeric Compound 1-1 except that 53.00 g of 3,6-dithia-1,8-octanediol was used. An aqueous dispersion of Polymeric Compound 1-4 with a solid content of 20% was also prepared. The average particle size of this aqueous dispersion was 155 nm. The glass transition temperature of Polymeric Compound 1-2 was 64° C.

Preparation of Support

A paper stock containing the following components was prepared:

100 parts by mass of a pulp slurry, 80 parts by mass of leaf bleached kraft pulp (LBKP) with a freeness of 450 ml CSF (Canadian Standard Freeness), 20 parts by mass of needle-leaf bleached kraft pulp (NBKP) with a freeness of 480 ml CSF, 0.60 part by mass of cationized starch, 10 parts by mass of heavy calcium carbonate, 15 parts by mass of light calcium carbonate, 0.10 part by mass of an alkyl ketene dimer, and 0.03 part by mass of a cationic polyacrylamide.

The paper stock was made into paper using a Fourdrinier paper machine. The paper was wet-pressed in three stages and was then dried with a multi-cylinder dryer. The resulting paper was impregnated with an aqueous solution of oxidized starch using a size press so as to have a solid content of 1.0 g/m$^2$ and was then dried. The resulting paper was machine-calendered, whereby base paper was obtained. The base paper had a basis weight of 170 g/m$^2$, a Stockigt sizing degree of 100 seconds, a gas permeability of 50 seconds, a Bekk smoothness of 30 seconds, and a Gurley stiffness of 11.0 mN.

The following composition was applied to the base paper in an amount of 25 g/m$^2$: a polymer composition containing 70 parts by mass of low-density polyethylene, 20 parts by mass of high-density polyethylene, and 10 parts by mass of titanium oxide. Furthermore, a polymer composition containing 50 parts by mass of high-density polyethylene and 50 parts by mass of low-density polyethylene was applied to the back surface of the base paper in an amount of 25 g/m$^2$, whereby a polymer-coated support was prepared.

Preparation of Alumina Hydrate Dispersions

The following compounds were mixed with 213 g of pure water: 100 g of Alumina Pigment 1 and 1.5 g of a deflocculation acid. Alumina Pigment 1 was an alumina hydrate, DISPERAL HP14, available from Sasol. The deflocculation acid was methanesulfonic acid. The amount of the deflocculation acid used was 1.5 parts by mass per 100 parts by mass of Alumina Pigment 1. The mixture was stirred for 30 minutes in a mixer, whereby Alumina Hydrate Dispersion 1 was prepared. Alumina Hydrate Dispersions 2 to 31 were prepared by substantially the same method as above. In the preparation of Alumina Hydrate Dispersions 2 to 31, the following acid was used as a deflocculation acid instead of methanesulfonic acid: ethanesulfonic acid, butanesulfonic acid, acetic acid, amidosulfonic acid, or benzenesulfonic acid. In the case of using Alumina Pigment 2 in addition to Alumina Pigment 1, Alumina Pigments 1 and 2 were mixed together in a powdery state and this mixture was prepared an alumina hydrate dispersion by substantially the same method as that used to prepare Alumina Hydrate Dispersion 1. Alumina Pigment 2 was Alu-C (officially called Aluminum Oxide C) available from Degussa.

Example 1

A polyvinyl alcohol was dissolved in ion-exchanged water, whereby an aqueous polyvinyl alcohol solution with a solid content of 9.0% by mass was obtained. The polyvinyl alcohol used was PVA 235, having a weight-average polymerization degree of 3,500 and a saponification degree of 88%, available from of Kuraray Co., Ltd. The aqueous polyvinyl alcohol solution was mixed with Alumina Hydrate Dispersion 1 such that the equation (X/Y)×100=9% holds, where X is the solid content of the aqueous polyvinyl alcohol solution and Y is the solid content of Alumina Hydrate Dispersion 1. Zirconium acetate, boric acid, and Polymeric Compound 1-1 were mixed with this mixture in amounts shown in Table 1, whereby a coating solution for forming an ink-receiving layer was obtained.

The coating solution was applied to the support in an amount of 35 g/m$^2$ using a sliding die. The temperature of the coating solution was 45° C. The coated support was dried at 80° C., whereby Inkjet Recording Medium 1 was prepared.

Examples 2 to 19 and Comparative Examples 1 to 10

Inkjet recording media were prepared in substantially the same manner as that described in Example 1 using Alumina Pigment 1, Alumina Pigment 2, deflocculation acids, Crosslinking Agent 1, Crosslinking Agent 2, and polymeric compounds as shown in Table 1. Alumina Pigment 1 was DISPERAL HP14 available from Sasol. Alumina Pigment 2 was Alu-C (officially called Aluminum Oxide C) available from Degussa.

In Comparative Examples 9 and 10, cationic urethane compounds were used instead of the polymeric compounds to prepare inkjet recording media. The cationic urethane compounds used were SUPERFLEX 620 (SF 620), having an average particle size of 30 nm and a glass transition temperature of 43° C., available from Dai-ichi Kogyo Seiyaku Co., Ltd. and SUPERFLEX 640 (SF 640), having an average particle size of 15 nm and a glass transition temperature of −17° C., available from Dai-ichi Kogyo Seiyaku Co., Ltd.

TABLE 1

| Examples and comparative examples | Alumina dispersions | Recording media | Base | Materials used to make up ink-receiving layers: Alumina Pigment 1 Type | Alumina Pigment 1 Percentage | Alumina Pigment 2 Type | Alumina Pigment 2 Percentage | Deflocculating acids Type | Crosslinking Agent 1 Type | Crosslinking Agent 1 Amount (*1) |
|---|---|---|---|---|---|---|---|---|---|---|
| Example 1 | Dispersion 1 | Recording Medium 1 | RC | HP14 | 100 | Alu-C | 0 | Methanesulfonic acid | Zirconium acetate | 0.15 |
| Example 2 | Dispersion 2 | Recording Medium 2 | RC | HP14 | 100 | Alu-C | 0 | Methanesulfonic acid | Zirconium acetate | 0.15 |
| Example 3 | Dispersion 3 | Recording Medium 3 | RC | HP14 | 100 | Alu-C | 0 | Methanesulfonic acid | Zirconium acetate | 0.15 |
| Example 4 | Dispersion 4 | Recording Medium 4 | RC | HP14 | 100 | Alu-C | 0 | Methanesulfonic acid | Zirconium acetate | 0.15 |
| Example 5 | Dispersion 5 | Recording Medium 5 | RC | HP14 | 100 | Alu-C | 0 | Methanesulfonic acid | Zirconium chloride | 0.15 |
| Example 6 | Dispersion 6 | Recording Medium 6 | RC | HP14 | 100 | Alu-C | 0 | Methanesulfonic acid | Zirconium nitrate | 0.15 |
| Example 7 | Dispersion 7 | Recording Medium 7 | RC | HP14 | 100 | Alu-C | 0 | Methanesulfonic acid | Zirconium acetate | 0.3 |
| Example 8 | Dispersion 8 | Recording Medium 8 | RC | HP14 | 100 | Alu-C | 0 | Methanesulfonic acid | Zirconium acetate | 1 |
| Example 9 | Dispersion 9 | Recording Medium 9 | RC | HP14 | 100 | Alu-C | 0 | Methanesulfonic acid | Zirconium acetate | 2 |
| Example 10 | Dispersion 10 | Recording Medium 10 | RC | HP14 | 100 | Alu-C | 0 | Methanesulfonic acid | Zirconium acetate | 3 |
| Example 11 | Dispersion 11 | Recording Medium 11 | RC | HP14 | 100 | Alu-C | 0 | Methanesulfonic acid | Zirconium acetate | 3 |
| Example 12 | Dispersion 12 | Recording Medium 12 | RC | HP14 | 100 | Alu-C | 0 | Methanesulfonic acid | Zirconium acetate | 1 |
| Example 13 | Dispersion 13 | Recording Medium 13 | RC | HP14 | 100 | Alu-C | 0 | Methanesulfonic acid | Zirconium acetate | 1 |
| Example 14 | Dispersion 14 | Recording Medium 14 | RC | HP14 | 100 | Alu-C | 0 | Methanesulfonic acid | Zirconium acetate | 1 |
| Example 15 | Dispersion 15 | Recording Medium 15 | RC | HP14 | 70 | Alu-C | 30 | Methanesulfonic acid | Zirconium acetate | 1 |
| Example 16 | Dispersion 16 | Recording Medium 16 | RC | HP14 | 60 | Alu-C | 40 | Methanesulfonic acid | Zirconium acetate | 1 |
| Example 17 | Dispersion 17 | Recording Medium 17 | RC | HP14 | 100 | Alu-C | 0 | ethanesulfonic acid | Zirconium acetate | 0.15 |
| Example 18 | Dispersion 18 | Recording Medium 18 | RC | HP14 | 100 | Alu-C | 0 | butanesulfonic acid | Zirconium acetate | 0.15 |
| Example 19 | Dispersion 19 | Recording Medium 19 | RC | HP14 | 100 | Alu-C | 0 | Methanesulfonic acid | Zirconium acetate | 0.15 |
| Example 20 | Dispersion 20 | Recording Medium 20 | RC | HP14 | 100 | Alu-C | 0 | Methanesulfonic acid | Zirconium acetate | 0.15 |
| Example 21 | Dispersion 21 | Recording Medium 21 | RC | HP14 | 100 | Alu-C | 0 | Methanesulfonic acid | Zirconium acetate | 0.15 |
| Comparative Example 1 | Dispersion 22 | Recording Medium 22 | RC | HP14 | 100 | Alu-C | 0 | Acetic acid | Zirconium acetate | 0.15 |
| Comparative Example 2 | Dispersion 23 | Recording Medium 23 | RC | HP14 | 100 | Alu-C | 0 | Methanesulfonic acid | Zirconium acetate | 4 |
| Comparative Example 3 | Dispersion 24 | Recording Medium 24 | RC | HP14 | 100 | Alu-C | 0 | Methanesulfonic acid | Zirconium acetate | 0.1 |
| Comparative Example 4 | Dispersion 25 | Recording Medium 25 | RC | HP14 | 100 | Alu-C | 0 | Methanesulfonic acid | Zirconium acetate | 0.15 |
| Comparative | Dispersion | Recording | RC | HP14 | 100 | Alu-C | 0 | Amidosulfuric | Zirconium | 0.15 |

TABLE 1-continued

| | | | | | | | | | | |
|---|---|---|---|---|---|---|---|---|---|---|
| Example 5 | 26 | Medium 26 | | | | | | acid | acetate | |
| Comparative Example 6 | Dispersion 27 | Recording Medium 27 | RC | HP14 | 100 | Alu-C | 0 | Benzenesulfuric acid | Zirconium acetate | 0.15 |
| Comparative Example 7 | Dispersion 28 | Recording Medium 28 | RC | HP14 | 100 | Alu-C | 0 | Methanesulfonic acid | Zirconium acetate | 0.15 |
| Comparative Example 8 | Dispersion 29 | Recording Medium 29 | RC | HP14 | 100 | Alu-C | 0 | Methanesulfonic acid | Zirconium acetate | 0.15 |
| Comparative Example 9 | Dispersion 30 | Recording Medium 30 | RC | HP14 | 100 | Alu-C | 0 | Methanesulfonic acid | Zirconium acetate | 0.15 |
| Comparative Example 10 | Dispersion 31 | Recording Medium 31 | RC | HP14 | 100 | Alu-C | 0 | Methanesulfonic acid | Zirconium acetate | 0.15 |

| Examples and comparative examples | Materials used to make up ink-receiving layers: Crosslinking Agent 2 Type | Crosslinking Agent 2 Amount (*1) | Polymeric compounds Type | Polymeric compounds Amount (*1) | Polymeric compounds Average particle size (nm) | Polymeric compounds Tg (° C.) | Crosslinking Agent 1/ polymeric compound |
|---|---|---|---|---|---|---|---|
| Example 1 | Boric acid | 0.8 | Polymeric compound 1-1 | 0.5 | 35 | 60 | 0.30 |
| Example 2 | Boric acid | 0.8 | Polymeric compound 1-1 | 2 | 35 | 60 | 0.08 |
| Example 3 | Boric acid | 0.8 | Polymeric compound 1-1 | 4 | 35 | 60 | 0.04 |
| Example 4 | Boric acid | 0.8 | Polymeric compound 1-1 | 8 | 35 | 60 | 0.02 |
| Example 5 | Boric acid | 0.8 | Polymeric compound 1-1 | 0.5 | 35 | 60 | 0.30 |
| Example 6 | Boric acid | 0.8 | Polymeric compound 1-1 | 0.5 | 35 | 60 | 0.30 |
| Example 7 | Boric acid | 0.8 | Polymeric compound 1-1 | 2 | 35 | 60 | 0.15 |
| Example 8 | Boric acid | 0.8 | Polymeric compound 1-1 | 2 | 35 | 60 | 0.50 |
| Example 9 | Boric acid | 0.8 | Polymeric compound 1-1 | 2 | 35 | 60 | 1.00 |
| Example 10 | Boric acid | 0.8 | Polymeric compound 1-1 | 2 | 35 | 60 | 1.50 |
| Example 11 | Boric acid | 0.8 | Polymeric compound 1-1 | 0.5 | 35 | 60 | 6.00 |
| Example 12 | Boric acid | 1 | Polymeric compound 1-1 | 2 | 35 | 60 | 0.50 |
| Example 13 | Boric acid | 2 | Polymeric compound 1-1 | 2 | 35 | 60 | 0.50 |
| Example 14 | Boric acid | 3 | Polymeric compound 1-1 | 2 | 35 | 60 | 0.50 |
| Example 15 | Boric acid | 2 | Polymeric compound 1-1 | 2 | 35 | 60 | 0.50 |
| Example 16 | Boric acid | 2 | Polymeric compound 1-1 | 2 | 35 | 60 | 0.50 |
| Example 17 | Boric acid | 0.8 | Polymeric compound 1-1 | 0.5 | 35 | 60 | 0.30 |
| Example 18 | Boric acid | 0.8 | Polymeric compound 1-1 | 0.5 | 35 | 60 | 0.30 |
| Example 19 | Boric acid | 0.8 | Polymeric compound 1-2 | 0.5 | 54 | 64 | 0.30 |
| Example 20 | Boric acid | 0.8 | Polymeric compound 1-3 | 0.5 | 96 | 60 | 0.30 |
| Example 21 | Boric acid | 0.8 | Polymeric compound 1-4 | 0.5 | 155 | 64 | 0.30 |
| Comparative Example 1 | Boric acid | 0.8 | Polymeric compound 1-1 | 0.5 | 35 | 60 | 0.30 |
| Comparative Example 2 | Boric acid | 0.8 | Polymeric compound 1-1 | 0.5 | 35 | 60 | 8.00 |
| Comparative Example 3 | Boric acid | 0.8 | Polymeric compound 1-1 | 10 | 35 | 60 | 0.01 |
| Comparative Example 4 | Boric acid | 0.8 | Polymeric compound 1-1 | 0.2 | 35 | 60 | 0.75 |
| Comparative Example 5 | Boric acid | 0.8 | Polymeric compound 1-1 | 0.5 | 35 | 60 | 0.30 |
| Comparative Example 6 | Boric acid | 0.8 | Polymeric compound 1-1 | 0.5 | 35 | 60 | 0.30 |
| Comparative Example 7 | Boric acid | 0.5 | Polymeric compound 1-1 | 0.5 | 35 | 60 | 0.30 |
| Comparative Example 8 | Boric acid | 4 | Polymeric compound 1-1 | 0.5 | 35 | 60 | 0.30 |
| Comparative | Boric | 0.8 | SF620 | 0.5 | 30 | 43 | 0.30 |

TABLE 1-continued

| | | | | | | | |
|---|---|---|---|---|---|---|---|
| Example 9 | acid | | | | | | |
| Comparative Example 10 | Boric acid | 0.8 | SF640 | 0.5 | 15 | −17 | 0.30 |

(*1) Parts by mass per 100 parts by mass of an alumina sample.

Evaluations

Methods of evaluating the inkjet recording media are as described below.

Evaluation 1: Bk O. D. value

Inkjet Recording Media 1 to 31 prepared as described above were measured for Bk O. D. value. In particular, a black solid pattern having an RGB value of (0, 0, 0) was printed on each of Inkjet Recording Media 1 to 31 using a recording unit, iP 4600, available from CANON KABUSHIKI KAISHA and Inkjet Recording Media 1 to 31 were left for one day and were then measured for color using Gretag Spectrolino available from GretagMacbeth. The measurement results are shown in Table 1.

Evaluation 2: Moisture Resistance

Inkjet Recording Media 1 to 31 prepared as described above were evaluated for moisture resistance. In particular, a blue solid image was printed on each of Inkjet Recording Media 1 to 31 using a recording unit, iP 4600, available from CANON KABUSHIKI KAISHA; the empty letters "Den-Kyou (in Japanese)" were printed on the blue solid image in 48-point and 10-point; and Inkjet Recording Media 1 to 31 were left for 14 days in a 30° C. atmosphere with a relative humidity of 90%. The bleeding of a colorant into the empty letters visually checked before and after Inkjet Recording Media 1 to 31 were left in the atmosphere. Inkjet Recording Media 1 to 31 were evaluated in accordance with standards below.

Rank 5: Empty letters printed in 10-point and 48-point have no bleed at all and are extremely good.

Rank 4: Empty letters printed in 10-point has a bleed and empty letters printed in 48-point have no bleed at all.

Rank 3: Empty letters printed in 10-point and 48-point are bled and are not entirely bled.

Rank 2: Empty letters printed in 10-point are entirely bled and empty letters printed in 48-point are not entirely bled.

Rank 1: Empty letters printed in 10-point and 48-point are entirely bled.

Evaluation 3: Ink Absorbency

Inkjet Recording Media 1 to 31 prepared as described above were evaluated for ink absorbency during high-speed printing. A recording unit used was one obtained by modifying a print treatment process of Pro 9000 available from CANON KABUSHIKI KAISHA. A printing process used was one-way printing such that printing was completed at a carriage speed of 15 inch/sec in one pass. A print pattern used was a pattern which had three colors, that is, cyan, yellow, and green, which was capable of being judged for boundary bleeding (so-called bleed), and to which the amount of ink applied was variable. The maximum amount of ink applied was set to 160% duty and was variable in 10% duty increments. Printing was performed in a high-humidity atmosphere having a temperature of 30° C. and a relative humidity of 80%. The term "100% duty" as used herein means that 22 ng of ink is applied to a 600 dpi square area. Inkjet Recording Media 1 to 31 were visually evaluated in accordance with standards below.

Rank 5: No beading occurs even at 160% duty.

Rank 4: Beading occurs at 160% duty and no beading is observed at 150% duty.

Rank 3: Beading occurs at 150% duty and no beading is observed at 130% duty.

Rank 2: Beading occurs at 130% duty and no beading is observed at 120% duty.

Rank 1: Beading occurs at 100% duty.

Evaluation 4: Cracking During Transferring

Ink-receiving layers were evaluated for cracking during transferring in such a manner that Inkjet Recording Media 1 to 31 prepared as described above were subjected to high-speed printing. The term "the cracking of an ink-receiving layer during transferring" as used herein means that an ink-receiving layer is cracked during the U-turn transferring of cut paper or the transferring of rolled paper. An evaluation method was as follows: metal rollers with different diameters were pressed against an inkjet recording medium and the inkjet recording medium was evaluated whether the inkjet recording medium was cracked when the inkjet recording medium is bent at a curvature corresponding to the diameter of one of the metal rollers. Inkjet Recording Media 1 to 31 were visually evaluated in accordance with standards below.

Rank 5: No cracking occurs even at a diameter of 8 mm.

Rank 4: No cracking occurs at a diameter of 12 mm and cracking occurs at a diameter of 8 mm.

Rank 3: No cracking occurs at a diameter of 20 mm and cracking occurs at a diameter of 12 mm.

Rank 2: No cracking occurs at a diameter of 25 mm and cracking occurs at a diameter of 20 mm.

Rank 1: Cracking occurs at a diameter of 25 mm.

Evaluation 5: Scratch Resistance During Transferring

Inkjet Recording Media 1 to 31 prepared as described above were evaluated for surface scratch during transferring in such a manner that Inkjet Recording Media 1 to 31 were subjected to high-speed printing. The term "surface scratch during transferring" as used herein means that an ink-receiving layer contacts a hard member, such as a roller, supporting the ink-receiving layer during transferring and the gloss of a contact portion of the ink-receiving layer is varied and is recognized as a scratch. An evaluation unit used was one obtained by modifying Pro 9000 available from CANON KABUSHIKI KAISHA. Black solid prints were visually evaluated for the visibility of a scratch in accordance with standards below. Visual evaluation was performed in two environments: an office environment (Environment 1) and an outdoor environment (Environment 2) of a fine day. Scratches were highly visible in the outdoor environment because of strong sunlight.

Rank 5: Any scratch is not highly visible in Environment 1 or 2.

Rank 4: A scratch is not highly visible in Environment 1 and is slightly visible in Environment 2.

Rank 3: A scratch is slightly visible in Environments 1 and 2.

Rank 2: A scratch is slightly visible in Environment 1 and is highly visible in Environment 2.

Rank 1: A scratch is s is highly visible in Environments 1 and 2.

Evaluation results of Examples 1 to 21 and Comparative Examples 1 to 10 are shown in Table 2.

TABLE 2

| Examples and comparative examples | Evaluation results | | | | |
|---|---|---|---|---|---|
| | Bk O.D. value | Moisture resistance | Ink absorbency | Cracking of ink-receiving layer during bending | Scratch resistance during transferring |
| Example 1 | 2.35 | 5 | 3 | 5 | 3 |
| Example 2 | 2.33 | 5 | 4 | 5 | 3 |
| Example 3 | 2.30 | 5 | 4 | 5 | 3 |
| Example 4 | 2.25 | 5 | 5 | 5 | 3 |
| Example 5 | 2.30 | 5 | 3 | 5 | 3 |
| Example 6 | 2.28 | 5 | 3 | 5 | 3 |
| Example 7 | 2.32 | 5 | 4 | 5 | 4 |
| Example 8 | 2.30 | 5 | 4 | 4 | 4 |
| Example 9 | 2.28 | 5 | 5 | 3 | 5 |
| Example 10 | 2.25 | 5 | 5 | 3 | 5 |
| Example 11 | 2.28 | 5 | 5 | 3 | 5 |
| Example 12 | 2.28 | 5 | 4 | 4 | 4 |
| Example 13 | 2.28 | 5 | 4 | 4 | 4 |
| Example 14 | 2.25 | 5 | 5 | 3 | 5 |
| Example 15 | 2.25 | 5 | 5 | 4 | 5 |
| Example 16 | 2.20 | 5 | 5 | 4 | 5 |
| Example 17 | 2.31 | 4 | 3 | 5 | 3 |
| Example 18 | 2.30 | 3 | 3 | 5 | 3 |
| Example 19 | 2.35 | 5 | 4 | 5 | 3 |
| Example 20 | 2.35 | 5 | 4 | 5 | 3 |
| Example 21 | 2.35 | 5 | 4 | 5 | 3 |
| Comparative Example 1 | 2.03 | 1 | 5 | 5 | 3 |
| Comparative Example 2 | 2.19 | 5 | 5 | 1 | 5 |
| Comparative Example 3 | 2.19 | 5 | 4 | 5 | 2 |
| Comparative Example 4 | 2.35 | 5 | 2 | 5 | 3 |
| Comparative Example 5 | 2.20 | 1 | 3 | 5 | 3 |
| Comparative Example 6 | 2.25 | 2 | 3 | 5 | 3 |
| Comparative Example 7 | 2.33 | 5 | 2 | 5 | 1 |
| Comparative Example 8 | 2.18 | 5 | 4 | 2 | 4 |
| Comparative Example 9 | 2.30 | 5 | 2 | 5 | 3 |
| Comparative Example 10 | 2.30 | 5 | 2 | 5 | 3 |

As is clear from the results shown in Table 2, in the examples, the O. D. value is large and Rank 3 or higher is obtained in the evaluation of moisture resistance, ink absorbency, cracking resistance, and scratch resistance. In the comparative examples, the O. D. value is relatively small and Rank 2 or lower is obtained in the evaluation of any one of moisture resistance, ink absorbency, cracking resistance, and scratch resistance. This confirms that a configuration according to the present invention is capable of achieving color developability, moisture resistance, ink absorbency, cracking resistance, and scratch resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-112546 filed May 19, 2011, which is hereby incorporated by reference herein in its entirety.

What is claimed is:

1. An inkjet recording medium comprising:

a support; and an ink-receiving layer which is provided on the support and which contains an alumina pigment, an alkylsulfonic acid having the carbon number of 1 or more and 4 or less, a polymeric compound, a water-soluble zirconium compound, and a boric acid or a borate, wherein the ink-receiving layer contains 0.5 parts or more and 8 parts or less by mass of the polymeric compound, 0.15 parts or more and 3 parts or less by mass of the water-soluble zirconium compound, and 0.8 parts or more and 3 parts or less by mass of the boric acid or the borate per 100 parts by mass of the alumina pigment; the polymeric compound is one obtained by cationizing with acid at least one amino group of a product, the product being obtained by the reaction of at least three compounds, that is, (i) a sulfur-containing organic compound containing 2 or more active hydrogen atoms, (ii) a polyisocyanate compound containing 2 or more isocyanate groups, and (iii) an amine compound containing 2 or more active hydrogen atoms; and the proportion B/A is 0.02 or more and 6 or less, where A represents parts by mass of the polymeric compound per 100 parts by mass of the alumina pigment and B represents parts by mass of the water-soluble zirconium compound per 100 parts by mass of the alumina pigment.

2. The inkjet recording medium according to claim 1, wherein the polymeric compound has a weight-average molecular weight of 2,000 to 150,000 and is at least one selected from the group consisting of compounds represented by the following formulae:

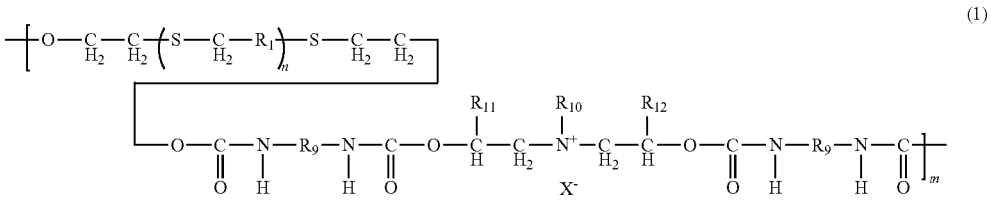

(1)

where n represents 1 or 2; $R_1$ represents a methylene group, an ethylene group, or a propylene group; $R_9$ represents an alkylene group or an aliphatic hydrocarbon group containing one or more polyalicyclic groups; $R_{10}$ represents an alkyl group having the carbon number of 1 or more and 4 or less; $R_{11}$ and $R_{12}$ independently represent a hydrogen atom or a methyl group; and $X^-$ represents an acid anion, (2)

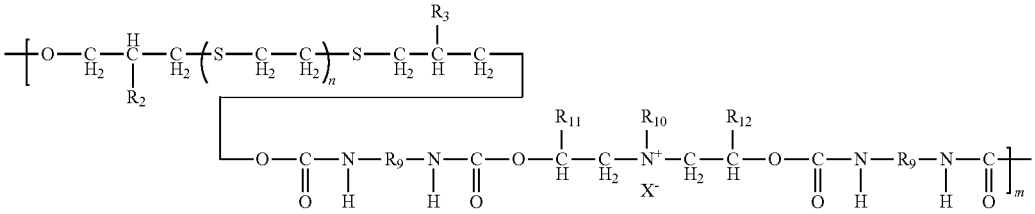

where n represents 1 or 2; $R_2$ and $R_3$ independently represent a hydrogen atom, a hydroxyl group, or an alkyl group and may be the same as or different from each other; $R_9$ represents an alkylene group or an aliphatic hydrocarbon group containing one or more polyalicyclic groups; $R_{10}$ represents an alkyl group having the carbon number of 1 or more and 4 or less; $R_{11}$ and $R_{12}$ independently represent a hydrogen atom or a methyl group; and $X^-$ represents an acid anion, (3)

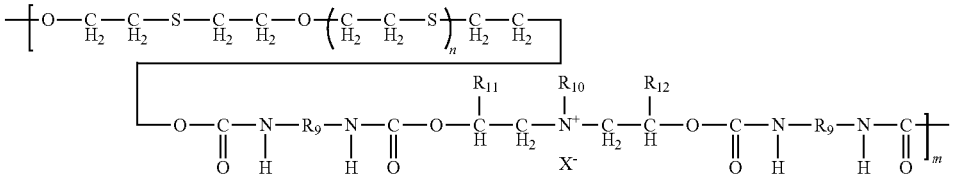

where n represents 0 or 1, $R_9$ represents an alkylene group or an aliphatic hydrocarbon group containing one or more polyalicyclic groups, $R_{10}$ represents an alkyl group having the carbon number of 1 or more and 4 or less, $R_{11}$ and $R_{12}$ independently represent a hydrogen atom or a methyl group, and $X^-$ represents an acid anion, (4)

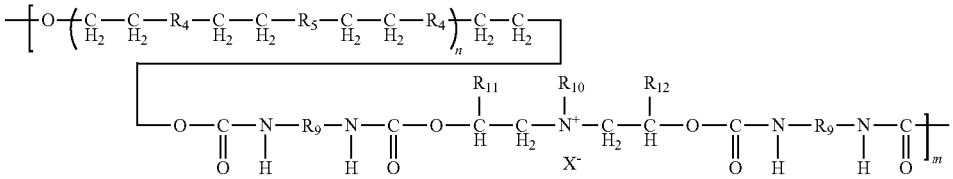

where n represents 1 or 2, $R_4$ represents a sulfur atom or an oxygen atom, $R_5$ represents a sulfur atom or a sulfonyl group, $R_4$ and $R_5$ are different from each other, $R_9$ represents an alkylene group or an aliphatic hydrocarbon group containing one or more polyalicyclic groups, $R_{10}$ represents an alkyl group having the carbon number of 1 or more and 4 or less, $R_{11}$ and $R_{12}$ independently represent a hydrogen atom or a methyl group, and $X^-$ represents an acid anion, (5)

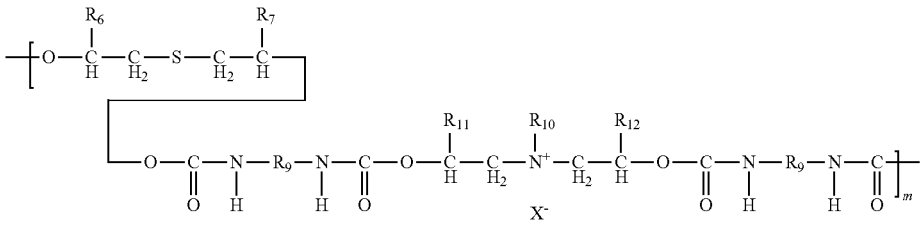

where $R_6$ and $R_7$ independently represent a hydrogen atom or a methyl group and may be the same as or different from each other, $R_9$ represents an alkylene group or an aliphatic hydrocarbon group containing one or more polyalicyclic groups, $R_{10}$ represents an alkyl group having the carbon number of 1 or more and 4 or less, $R_{11}$ and $R_{12}$ independently represent a hydrogen atom or a methyl group, and $X^-$ represents an acid anion, and (6)

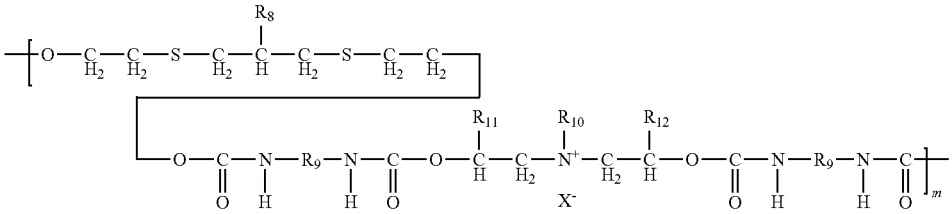

where $R_8$ represents a hydroxyl group or an alkyl group, $R_9$ represents an alkylene group or an aliphatic hydrocarbon group containing one or more polyalicyclic groups, $R_{10}$ represents an alkyl group having the carbon number of 1 or more and 4 or less, $R_{11}$ and $R_{12}$ independently represent a hydrogen atom or a methyl group, and $X^-$ represents an acid anion.

3. The inkjet recording medium according to claim 1, wherein the alkylsulfonic acid is methanesulfonic acid.

4. The inkjet recording medium according to claim 1, wherein the alumina pigment contains an alumina hydrate or contains the alumina hydrate and a vapor phase process alumina and the mass ratio of the alumina hydrate to the vapor phase process alumina ranges from 100:0 to 70:30.

5. The inkjet recording medium according to claim 1, wherein the proportion B/A is 0.15 or more and 1.5 or less.

6. The inkjet recording medium according to claim 1, wherein the water-soluble zirconium compound is a zirconium acetate.

* * * * *